US006876161B2

(12) United States Patent
Chung

(10) Patent No.: US 6,876,161 B2
(45) Date of Patent: Apr. 5, 2005

(54) TRANSFORMER FOR CATHODE TUBE INVERTER

(76) Inventor: Yu-Lin Chung, No. 4, Lane 130, Nan-Kang Rd , Sec. 3, Taipei (TW)

( * ) Notice: Subject to any disclaimer, the term of this patent is extended or adjusted under 35 U.S.C. 154(b) by 13 days.

(21) Appl. No.: 10/446,095

(22) Filed: May 28, 2003

(65) Prior Publication Data

US 2004/0239264 A1 Dec. 2, 2004

(51) Int. Cl.[7] ..... H01J 29/51
(52) U.S. Cl. ..... 315/368.28; 336/221
(58) Field of Search ..... 315/368.25, 368.28; 336/15, 20, 170, 182, 192, 195, 213, 220–223, 208

(56) References Cited

U.S. PATENT DOCUMENTS 4,311,978 A * 1/1982 Crockett et al. ..... 336/92
5,574,420 A * 11/1996 Roy et al. ..... 336/200
5,642,249 A * 6/1997 Kuznetsov ..... 361/58
5,942,893 A * 8/1999 Terpay ..... 324/207.18
6,414,582 B1 * 7/2002 Brkovic et al. ..... 336/200
6,611,190 B2 * 8/2003 Chui et al. ..... 336/198
2004/0085173 A1 * 5/2004 Decristofaro et al. ..... 336/178

* cited by examiner

*Primary Examiner*—Thuy Vinh Tran
(74) *Attorney, Agent, or Firm*—Bacon & Thomas PLLC

(57) ABSTRACT

A transformer for cathode tube inverter. The transformer includes an iron core assembly having first, second, third and fourth iron cores, each having a U-shape, and a first wire rack having a first wire winding portion, and a first hollow portion for accommodating the first iron. The transformer further includes a second wire rack having a hollow second wire winding portion, and a second portion for accommodating the second iron core and the third iron core, a third wire rack having a third wire winding portion, and a third hollow wire portion for accommodating the fourth iron core and a primary coil is shared within the iron cores. The primary coil and secondary coils are completely isolated with respect to electric circuits, and the secondary coils are completely or mostly, as well as mutually isolated with respect to magnetic circuits.

8 Claims, 8 Drawing Sheets

2a

2b

TRANSFORMER FOR CATHODE TUBE INVERTER

BACKGROUND OF THE INVENTION (a) Field of the Invention

The invention relates to a transformer for cathode tube inverter, and more particularly, to a twin-like U-shaped or a triplet-like transformer, wherein a primary coil thereof is shared, the primary coil and other secondary coils thereof are completed isolated with respect to electric circuits, and the secondary coils are completely or mostly as well as mutually isolated with respect to electric circuits. By having magnetic circuits completely or mostly as well as mutually isolated, miscellaneous complications resulted from an inverter simultaneously driving two or more light tubes are minimized.

(b) Description of the Prior Art

To have a conventional inverter of a cathode tube simultaneously drive two or more light tubes, two sets (or more) of circuits and two or more transformers are needed. FIG. 1 shows a conventional transformer 100 used in an inverter. Referring to FIG. 1, when driving two or more light tubes, light intensity is not evenly distributed in case of two light tubes in parallel, meaning that currents in the light tubes are unbalanced. As a result, in order to maintain a balance of currents, more electronic components are required, and thus increasing production cost. For light tubes arranged in series, a high output voltage of the transformer from multiplying by the number of the light tubes is required. It is not entirely safe to use such devices, and expenses of related components are similarly increased.

Accompanied with rapid advancement of display technologies, liquid-crystal-display (LCD) monitors are gradually replacing conventional cathode-ray-tube (CRT) monitors for being smaller in thickness, occupying relatively smaller spaces, and having stable definition without flickering. An interior of an LCD monitor is provided with a backlight module, which contains a high-voltage driven cathode tube serving as a light source in a backlight system thereof. This type of light tube is generally driven by an inverter, and has a high-voltage transformer apart from driving circuits. Furthermore, sizes of LCD monitors are currently becoming larger and larger, and some even replace televisions we use at the present time. However, the prior inverter is designed to make a single transformer drive one light tube only, and hence the aforesaid complications are incurred when driving two or more light tubes.

SUMMARY OF THE INVENTION

The object of the invention is to provide a twin-like U-shaped or a triplet-like transformer, wherein a middle coil thereof serves as a primary coil for input, and coils at two sides thereof serve as secondary coils for output. A driving circuit therein may be simplified owing to the primary coil shared, and complications caused by requirements of light tubes connected in series or parallel are also eliminated. In addition, by sharing the primary coil, the primary coil and the secondary coils are situated in a same iron core assembly with resultingly same output parameters as well, thereby smoothing away issues of light intensity differences of light tubes. It is also unquestionable that a number of transformers used is reduced for that a single transformer is capable of driving a multiple of light tubes.

DETAILED DESCRIPTION OF THE PREFERRED EMBODIMENTS

To better understand the invention, detailed descriptions shall be given with the accompanying drawings hereunder.

Figure 1:
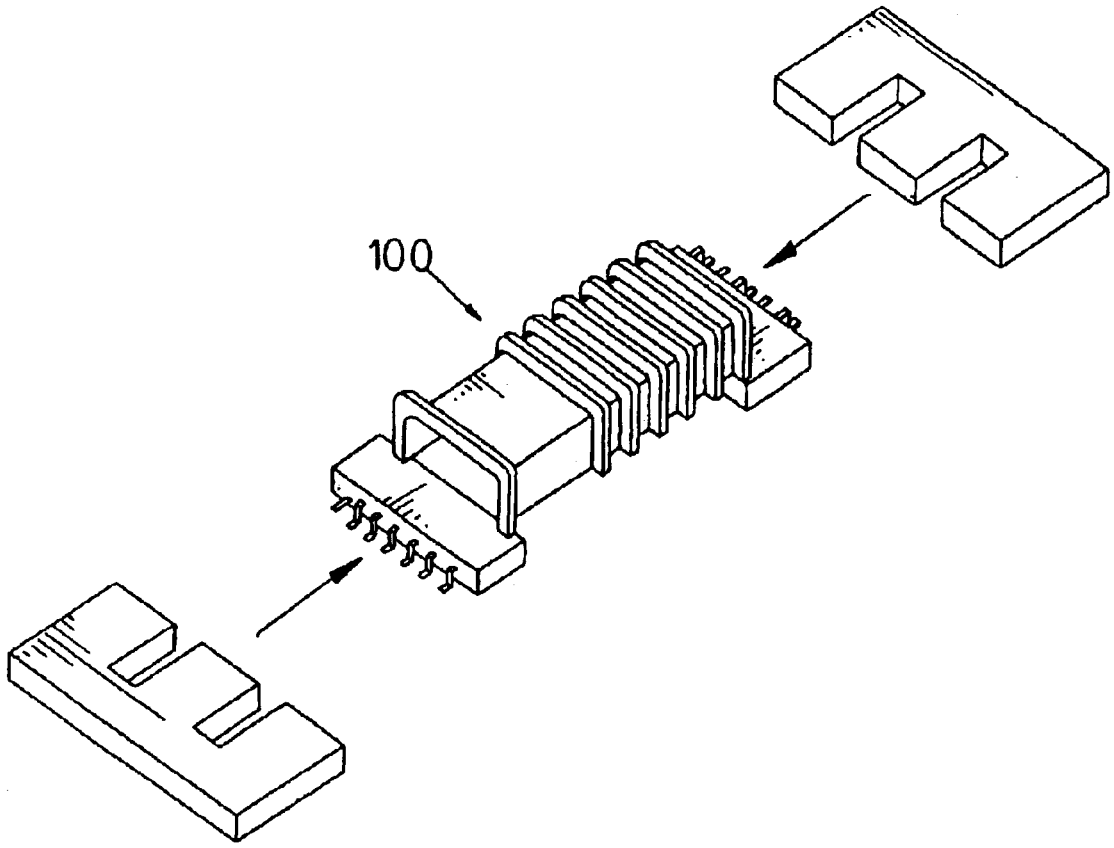
FIG.1 (PRIOR ART)
FIG. 1 shows a conventional exploded elevational schematic view of a prior transformer used in an inverter.
Figure 2:
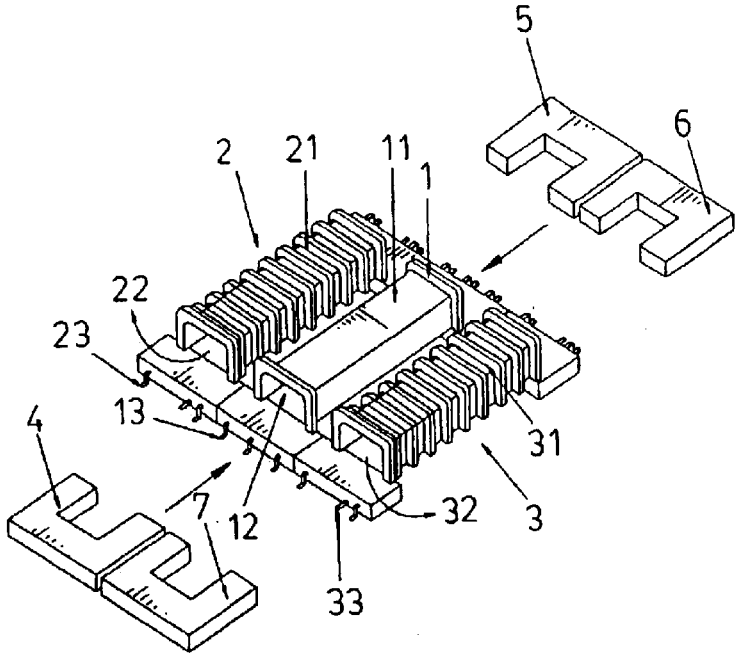
FIG. 2 shows an exploded elevational schematic view of a transformer for inverter according to the invention.
Figure 2:
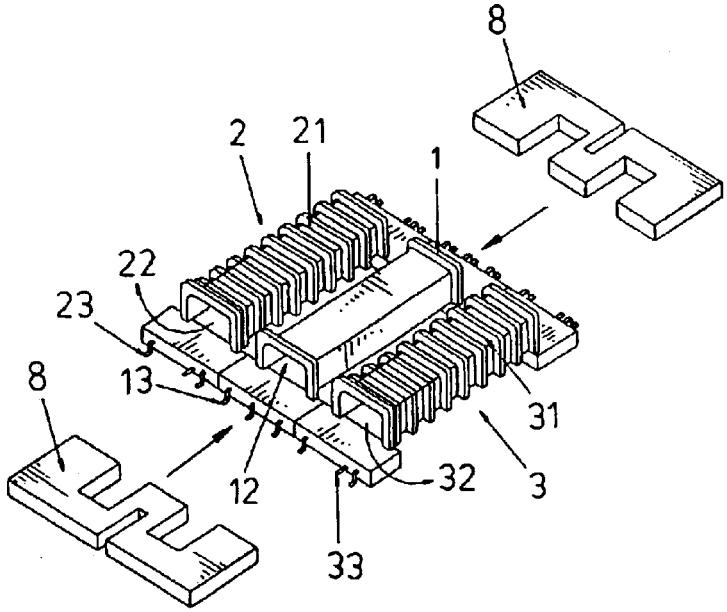

Referring to FIG. 2, the transformer in accordance with the invention comprises three wire racks 1, 2 and 3, and four U-shaped iron cores 4, 5, 6 and 7 as shown in FIG. 2*a*; or three wire racks 1, 2 and 3, and two deformed E-shaped iron cores 8 as shown in FIG. 2*b*. Wherein, peripherals close to centers of the three wire racks 1, 2 and 3 are disposed with wire winding portions 11, 21 and 31 having a plurality of intervals. The wire winding portions 11, 21 and 31 are wound with coils and are hollow structures, and hollow portions 12, 22 and 32 thereof are for accommodating the iron cores 4, 5, 6 and 7 (or the iron cores 8). The wire racks 1, 2 and 3 are further provided and joined with a plurality of terminals 13, 23 and 33 connected with the coils, respectively.

The aforesaid transformer is a twin-like U-shaped or a deformed dual E-shaped transformer, wherein the coil at the middle wire rack 1 is a primary coil serving as input, whereas as the coils at the two side wire racks 2 and 3 are secondary coils serving as output. The primary coil is shared within the iron cores 4, 5, 6 and 7 (or the iron cores 8) having same properties, and therefore the primary coil is completely isolated with other secondary coils with respect to electric circuits. By completely isolating the secondary coils with respect to electric circuits, and by completely or mostly as well as mutually isolating the secondary coils with respect to magnetic circuits, complications caused by requirements for driving two or more light tubes are eliminated.

Figure 3:
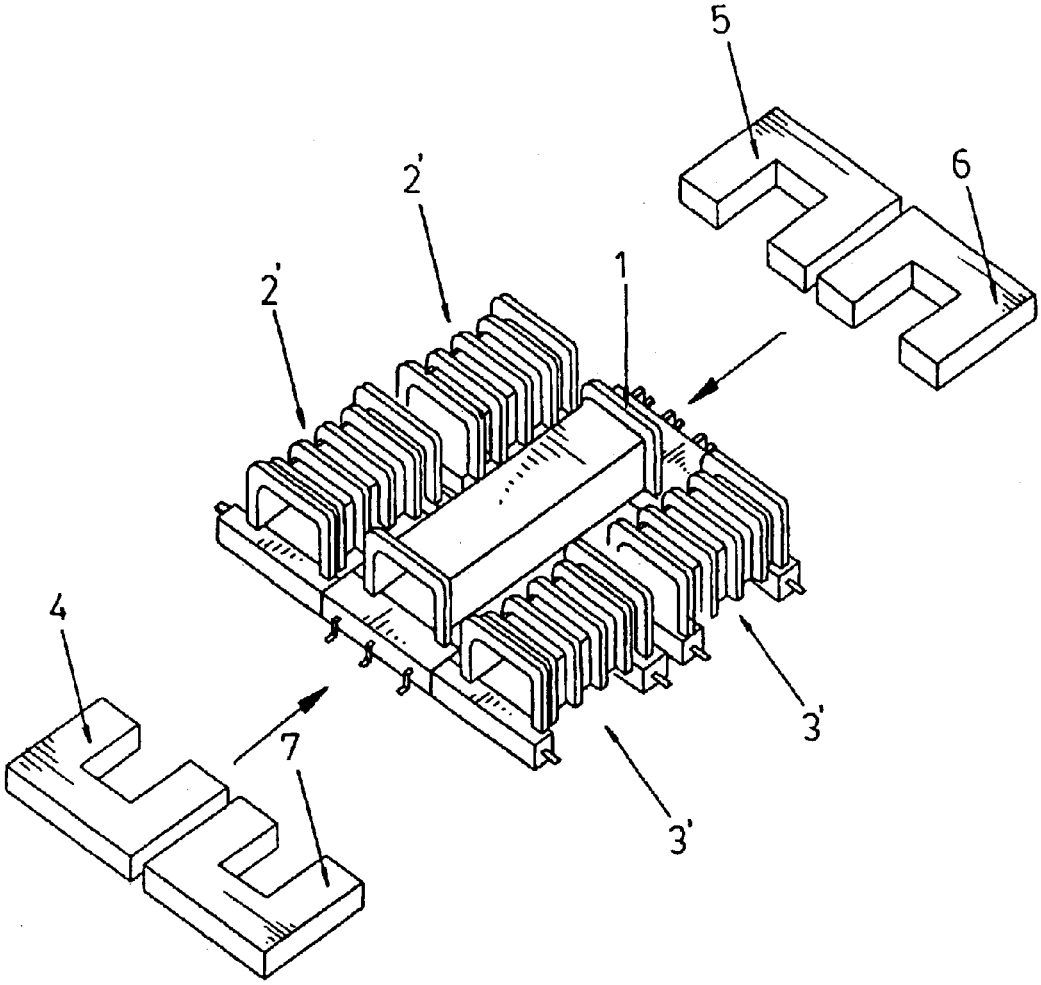
FIG. 3 shows a schematic view of an embodiment according to the invention.

Referring to FIG. 3, in accordance with the invention, the middle wire rack 1 may be disposed with two sets of wire racks 2' and 3' at two sides thereof, respectively, and thus adding up to four wire racks in total.

Figure 4:
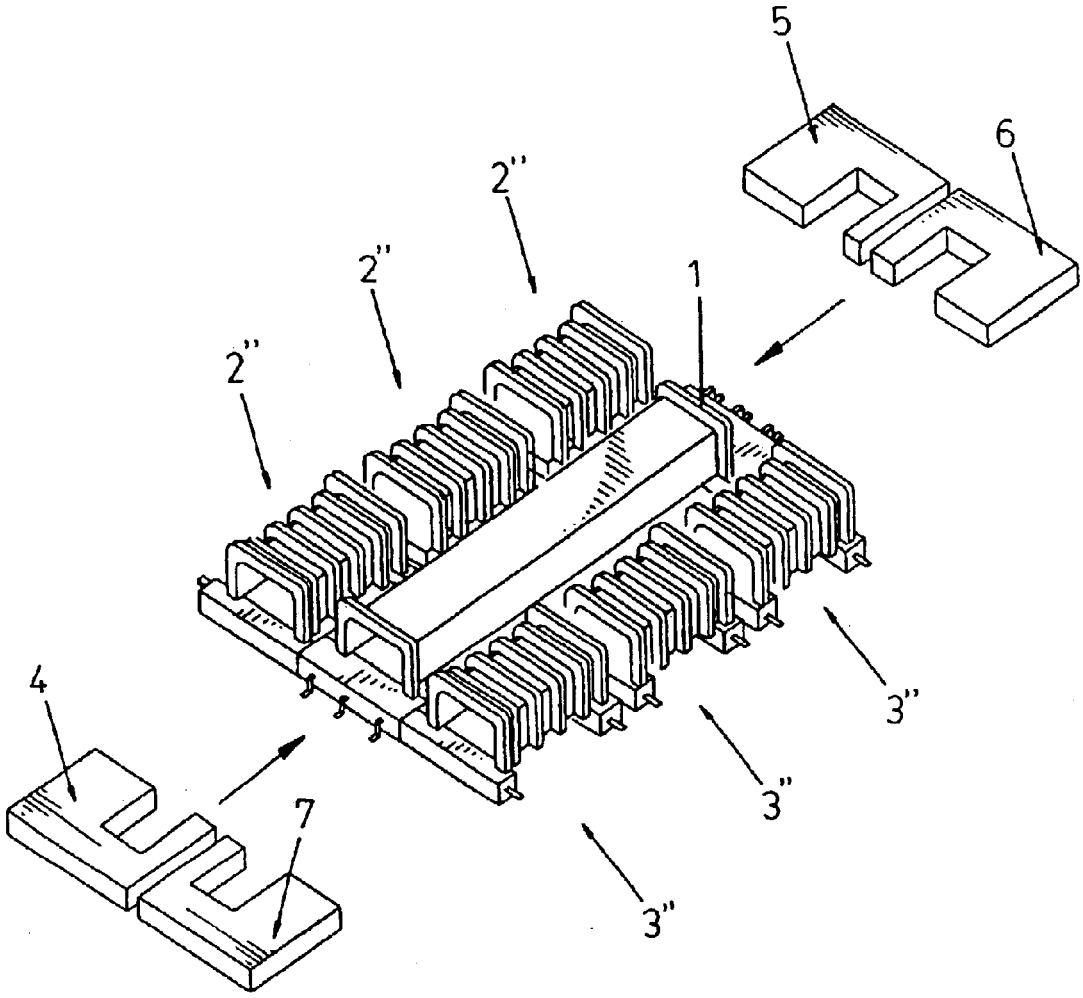
FIG. 4 shows another schematic view of an embodiment according to the invention.

Referring to FIG. 4, in accordance with the invention, the middle wire rack 1 may be disposed with three (or more) sets of wire racks 2' and 3' at two sides thereof, respectively, and thus adding up to six (or more) wire racks in total.

Figure 5:
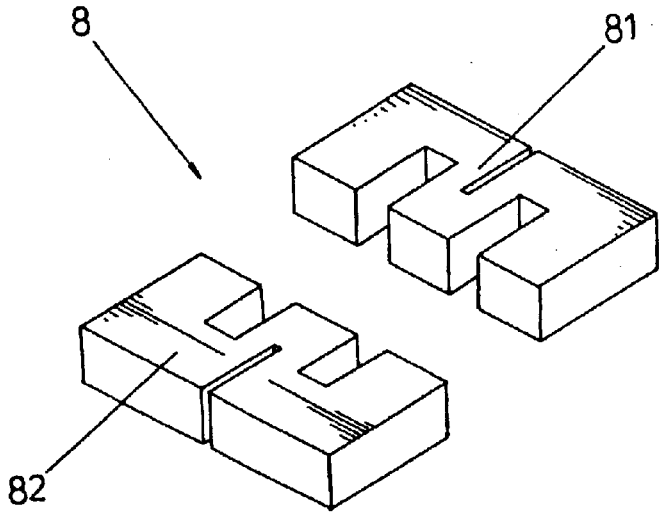
FIGS. 5 to 11 are elevational views illustrating structures of core assemblies according to the invention.

Referring to FIG. 5, the iron cores 8 may be a combination of two E-shaped iron cores 81 and 82, and thus making up to four deformed U-shaped iron cores.

The following structures of iron cores are applicable to the invention. The characteristics thereof are that the primary coil therein is shared, and is completely isolated from other secondary coils with respect to electric circuits. In addition, the secondary coils are completely or mostly as well as mutually isolated with respect to magnetic circuits.

Figure 6:
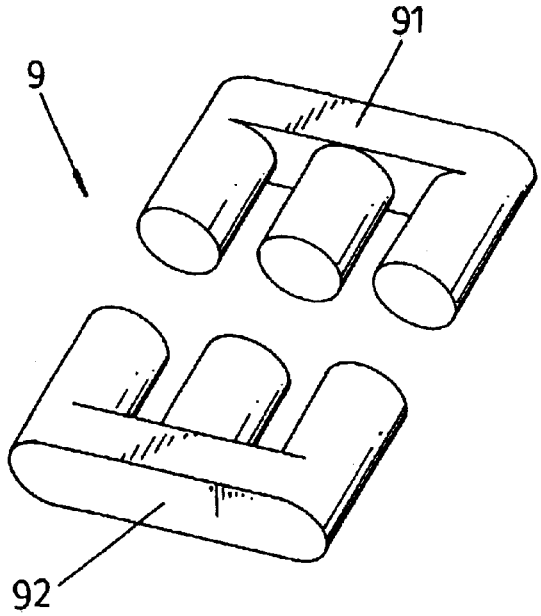

Referring to FIG. 6, the iron cores 9 may be combination of two E-shaped iron cores 91 and 92.

Figure 7:
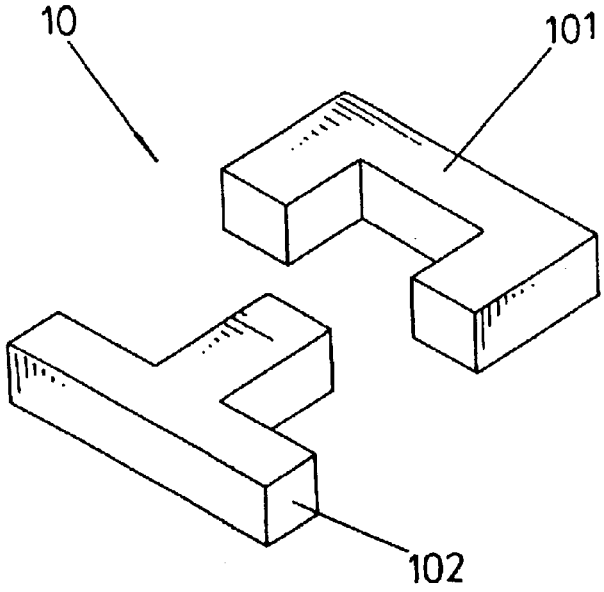

Referring to FIG. 7, an iron core assembly 10 may be a combination of a U-shaped iron core 101 and a T-shaped iron core 102.

Figure 8:
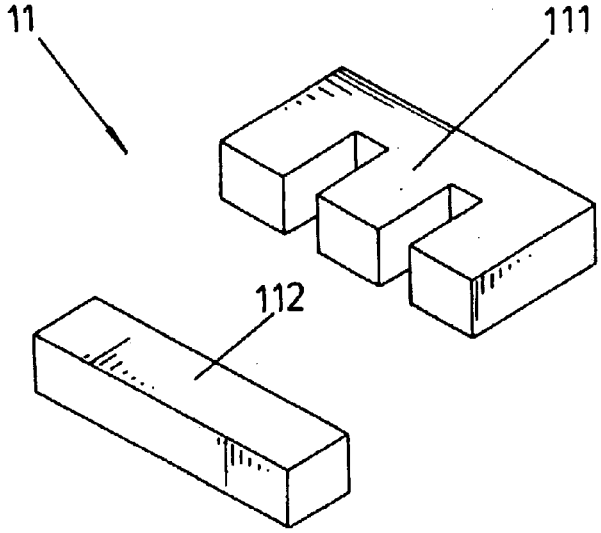

Referring to FIG. 8, an iron core assembly 11 may be a combination of an E-shaped iron core 111 and an I-shaped iron core 112.

Figure 9:
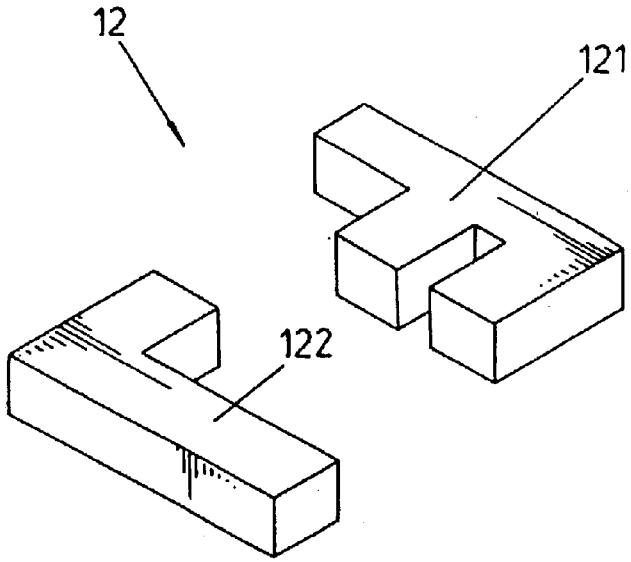

Referring to FIG. 9, an iron core assembly 12 may be a combination of an F-shaped iron core 121 and an L-shaped iron core 122.

Figure 10:
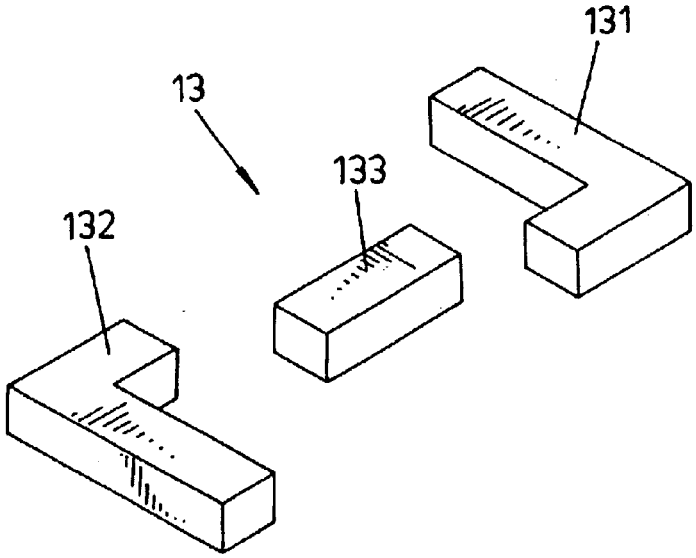

Referring to FIG. 10, an iron core assembly 13 may be a combination of two L-shaped iron cores 131 and 132, and an I-shaped iron core 133.

Figure 11:
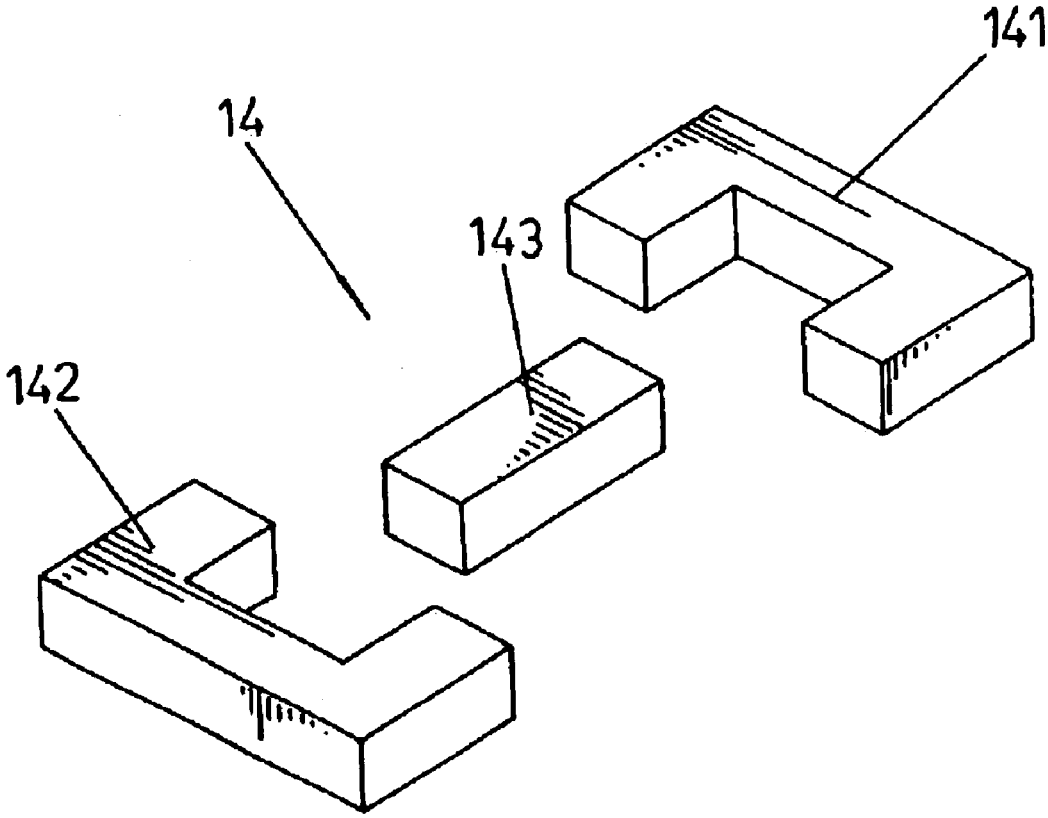

Referring to FIG. 11, an iron core assembly 14 may be a combination of two U-shaped iron cores 141 and 142, and an I-shaped iron core 143.

Conclusive from the above, the invention utilizes a transformer operating in coordination with combinations of side wire racks in multiples of two (two, four, six, eight and so on), and therefore the invention is capable of driving light tubes of equal quantity to the wire racks. Furthermore, light intensity of each of the light tubes is the same for that the wire racks are situated in a same iron core assembly.

It is of course to be understood that the embodiments described herein are merely illustrative of the principles of the invention and that a wide variety of modifications thereto may be effected by persons skilled in the art without departing from the spirit and scope of the invention as set forth in the following claims.

What is claimed is:

1. A transformer for cathode tube inverter comprising:

an iron core assembly having first, second, third and fourth iron cores, each having a U-shape;

a first wire rack having a first wire winding portion, and a first hollow portion for accommodating the first iron core;

a second wire rack having a hollow second wire winding portion, and a second hollow portion for accommodating the second iron core and the third iron core;

a third wire rack having a third wire winding portion, and a third hollow wire portion for accommodating the fourth iron core; and a primary coil is shared within the iron cores, the primary coil and secondary coils are completely isolated with respect to electric circuits, and the secondary coil are completely or mostly, as well as mutually isolated with respect to magnetic circuits.

2. The transformer for cathode tube inverter in accordance with claim 1, wherein the shared primary coil works in coordination with combinations of the secondary coils in multiples of two including two, four, six and so on.

3. The transformer for cathode tube inverter in accordance with claim 1, wherein the iron core assembly comprises two deformed E-shaped iron cores.

4. The transformer for cathode tube inverter in accordance with claim 1, wherein the iron core assembly comprises two L-shaped iron cores and one I-shaped iron core.

5. The transformer for cathode tube inverter in accordance with claim 1, wherein the iron core assembly comprises two U-shaped iron cores and one I-shaped iron core.

6. The transformer for cathode tube inverter in accordance with claim 1, wherein the iron core assembly comprises one U-shaped iron core and one T-shaped iron core.

7. The transformer for cathode tube inverter in accordance with claim 1, wherein the iron core assembly comprises one E-shaped iron core and one I-shaped iron core.

8. The transformer for cathode tube inverter in accordance with claim 1, wherein the iron core assembly comprises one F-shaped iron core and one L-shaped iron core.

* * * * *